United States Patent [19]

Stringer

[11] Patent Number: 4,767,367

[45] Date of Patent: Aug. 30, 1988

[54] INTEGRATED COMBINATION PROPELLER DRIVE SHAFT FAIRING AND WATER INTAKE SEA CHEST ARRANGEMENT, FOR HIGH SPEED OPERATING MARINE CRAFT

[75] Inventor: Robert A. Stringer, Slidell, La.

[73] Assignee: Textron Inc., Providence, R.I.

[21] Appl. No.: 42,674

[22] Filed: Apr. 27, 1987

[51] Int. Cl.[4] ..... B63H 21/10

[52] U.S. Cl. ..... 440/88; 440/78

[58] Field of Search ..... 114/140; 440/78, 82, 440/88, 89, 113

[56] References Cited

U.S. PATENT DOCUMENTS

| | | | |
|---|---|---|---|
| 1,090,584 | 3/1914 | Ventrice | 440/88 |
| 2,630,094 | 3/1953 | Hacker | 440/82 |
| 4,360,350 | 11/1982 | Grover | 114/140 |

*Primary Examiner*—Sherman D. Basinger
*Assistant Examiner*—Jesûs D. Sotelo
*Attorney, Agent, or Firm*—Bean, Kauffman & Bean

[57] ABSTRACT

The propeller shaft fairing is U-shaped in vertical section, and is partitioned to provide two separate sea chests from which water may be drawn for engine cooling purposes. The wall of the fairing in the region of the foremost sea chest is slot-wise apertured parallel to the propeller shaft and adjacent to the uprising side of the shaft when it is rotating to propel the craft forwardly, whereupon water is both rammed and pumped into the forward sea chest. The wall of the fairing in the region of the rearmost sea chest is apertured so that when the craft is moving in reverse water is rammed thereinto. Thus, under all conditions an adequate source of cooling water is available via at least one of the sea chests. The cooling water pump intake conduit includes separate branches drawing from the sea chests, and these branches are valve controlled automatically by means of the craft's operating control system.

10 Claims, 4 Drawing Sheets

Fig. 4.
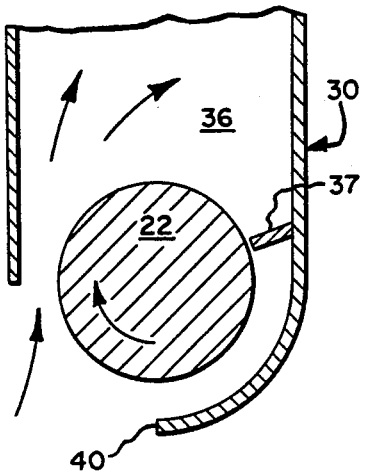
Fig. 5.
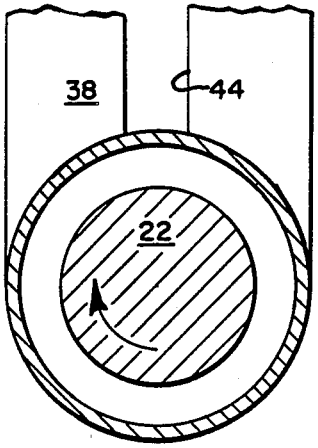
Fig. 9.
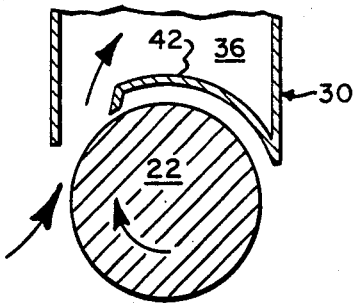
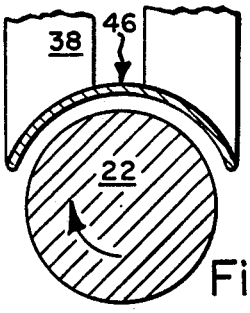
Fig. 10.
Fig. 6.
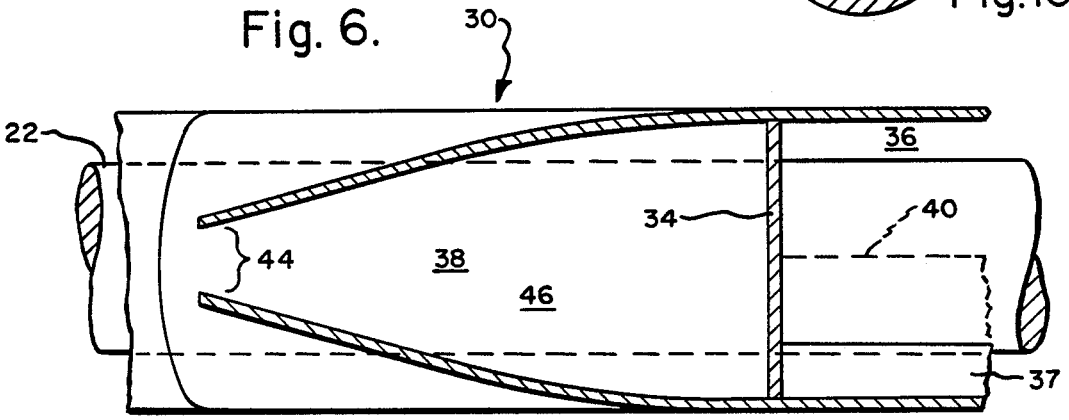
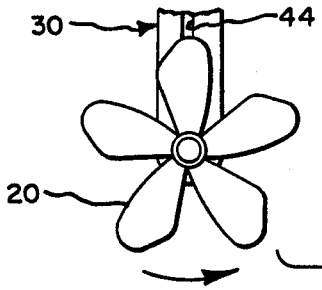
AHEAD
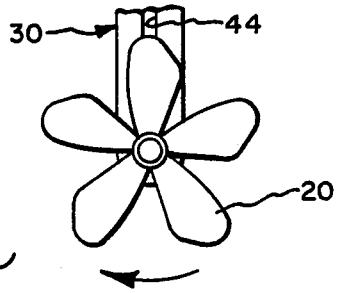
Fig. 7.
Fig. 8.
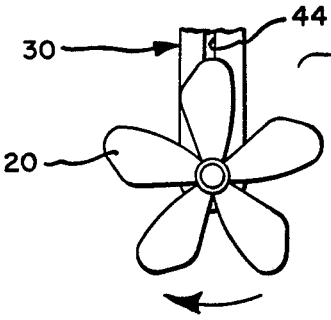
ASTERN
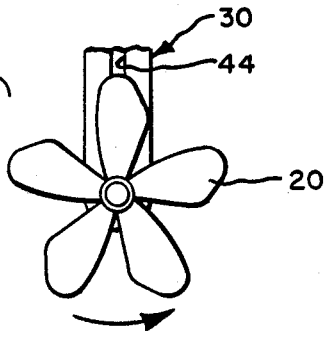

INTEGRATED COMBINATION PROPELLER DRIVE SHAFT FAIRING AND WATER INTAKE SEA CHEST ARRANGEMENT, FOR HIGH SPEED OPERATING MARINE CRAFT

BACKGROUND AND OBJECTS OF THE INVENTION

This invention relates to high speed screw propelled marine surface operating craft such as are of the monohull or multiple hull type; or may be of the surface effect ship type characterized by having a main hull subtended by opposite side hulls and flexible bow and stern seals confining thereunder an air cushion which operates to elevate the main hull above the water surface. In such vessels, the propeller shaft(s) extend from the below-chine surfaces of the craft at an angle.

The primary object of the invention is to provide improved shroud or fairing means to reduce the drag normally associated with propulsion-related appendages on such high speed operating craft when driven by fully submerged propellers. Another object of the invention is to reduce the tendency inherently operative in prior art arrangements to broach the intakes to water pump supply conduits (such as are required by such craft for engine cooling purposes or the like) during high speed ship maneuvering directional turnings, and/or when the craft is operating in the presence of severe sea state conditions.

BRIEF SUMMARY OF THE INVENTION

In accordance with this invention the beyond hull extending portions of the propeller shafts are supported and enclosed by externally streamlined hollow shrouds or "fairings" extending from the hull. Separate sea chests occupy the foremost and rearmost portions of the fairings into which extend separate branches of the water intake conduits from and through which water is pumped to the engine cooling system. These branches are valve-controlled automatically by means of the craft's operating control system, whereby when the craft is moving "ahead", water is drawn from the forward sea chest, but when the craft is moving in "reverse" water is drawn from the rearmost sea chest. The forward sea chest is formed with a water inlet opening of such configuration that when the craft is moving ahead water is thereby rammed into the forward sea chest; and the rearmost sea chest is formed with a water inlet opening of such configuration that when the craft is moving in reverse, water is thereby rammed into the rearmost sea chest.

Furthermore, the water inlet opening through the fairing into the forward sea chest is so located relative to the propeller shaft that when the shaft is rotating so as to propel the craft ahead, the water inlet opening is located adjacent the uprising side of the propeller shaft. Thus, the invention utilizes the capability of a shaft when rotating in water to operate as a pump for moving water in the direction of its rotation. Therefore, whether moving ahead or astern, by means of this sea chest arrangement a constantly adequate supply of water is made available for pumping into the engine cooling system of the vessel.

BRIEF DESCRIPTION OF THE DRAWING

Although the invention is similarly applicable to monohull or catamaran type screw propelled type craft, the invention is illustrated herein by way of example only as being embodied in a surface effect type ship (SES) by means of the accompanying drawing wherein:

FIGS. 4 and 5 are fragmentary further enlarged scale sectional views taken as along lines 4—4 and 5—5, respectively, of FIG. 3;

FIG. 6 is a fragmentary enlarged scale sectional view taken as along line 6—6 of FIG. 3;

FIGS. 7 and 8 are rear end elevational views showing how the ship's propellers rotate when driving the ship ahead and astern, respectively;

FIG. 9 is a fragmentary sectional view of a configurational modification of the sea chest inlet arrangement of FIG. 4;

FIG. 10 corresponds to FIG. 5, and further illustrates the modified configuration thereof shown in FIG. 9;

DETAILED SPECIFICATION

Therefore, by way of this example, the invention is illustrated by the accompanying drawing as being embodied in a surface effect type ship having a main hull 14. Rigid side hulls 16—16 extend therebelow along opposite sides of the main hull, and flexible bow and stern seals as shown at 18,19, respectively, complete the air cushion confining means under the main hull. In this case, the ship is shown as being driven by a pair of fully submerged propellers 20—20; the propellers being carried at the aft ends of corresponding drive shafts 22—22 which extend through the below-chine portions 24 of the side hulls and incline downwardly therefrom so as to dispose the propellers 20 just ahead of rudders 26. Thus, as is customary in the art, steering of the ship is achieved by use of the rudders as well as by directional and speed differential control of the propellers 20—20.

Figure 1:
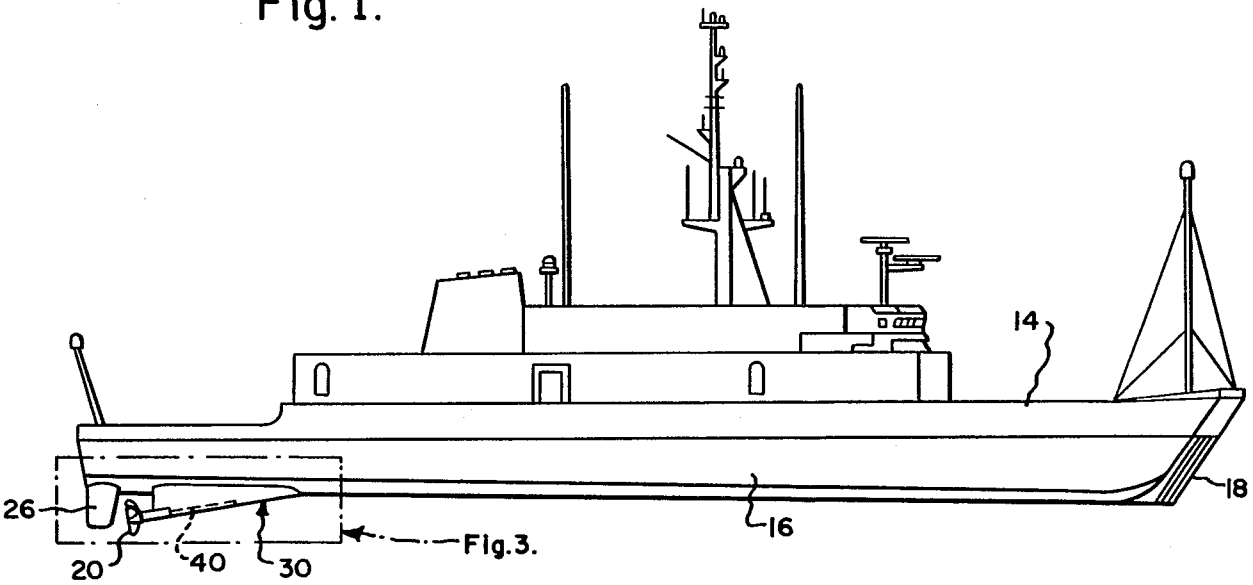
FIG. 1 is a starboard side elevational view of an SES employing a combination fairing and sea chest arrangement of the present invention.
Figure 2:
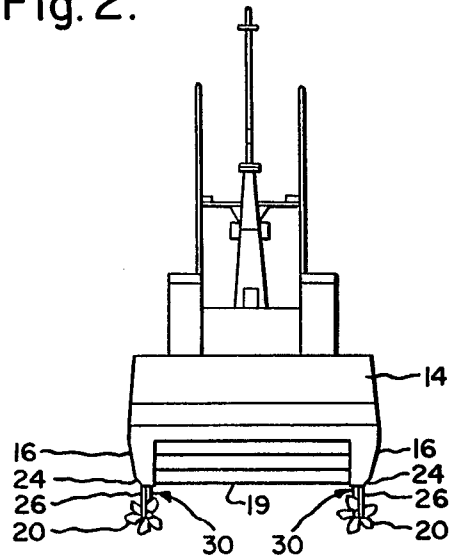
FIG. 2 is a stern end elevational view of the SES of FIG. 1.
Figure 3:
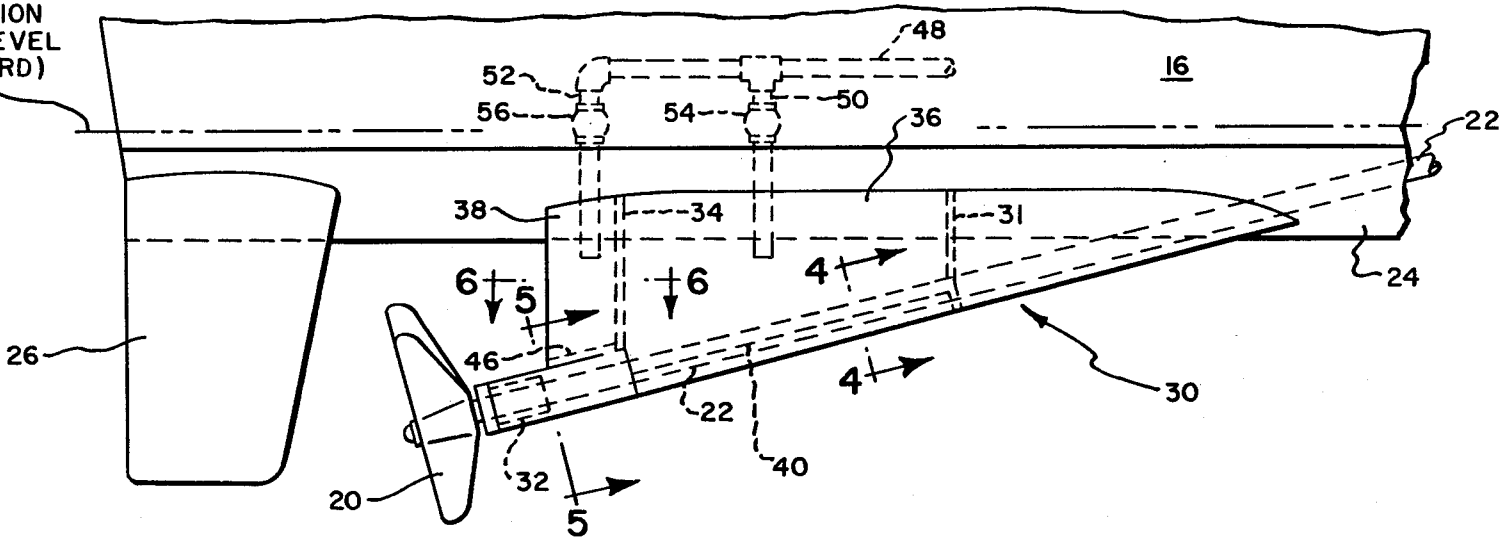
FIG. 3 is an enlarged scale fragmentary side elevational view of that starboard portion of the ship which is identified in FIG. 1 by the tag "FIG. 3"
Figure 11:
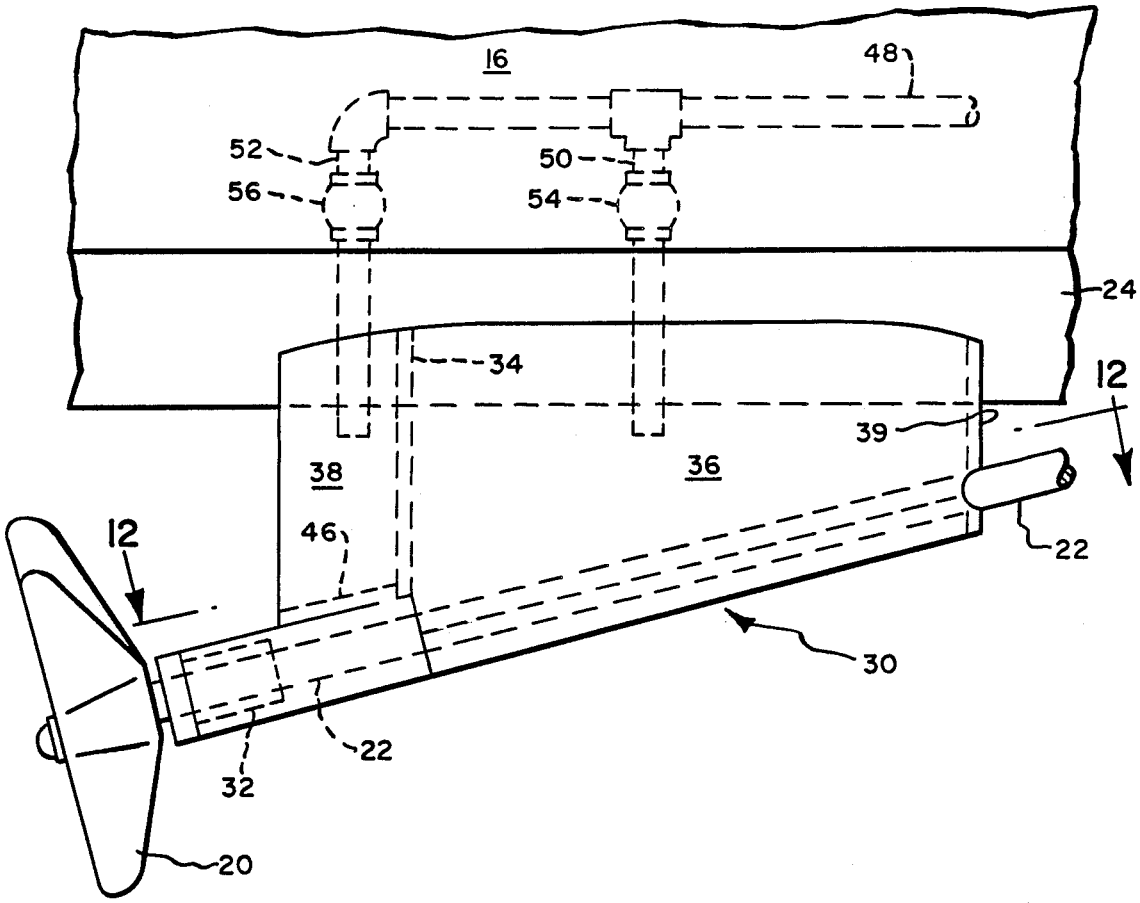
FIG. 11 corresponds to FIG. 3, but shows how the fairing may be in the form of a shaft support strut.
Figure 12:
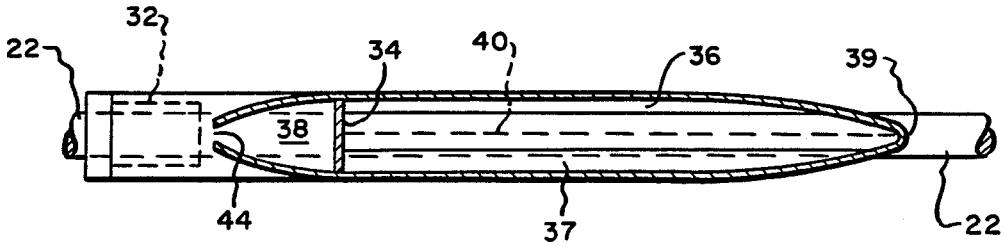
FIG. 12 is a sectional view taken along line 12—12 of FIG. 11.

As shown at FIGS. 1 and 3, the combination fairing and sea chest device of the invention comprises a generally streamlined hollow shell or shroud as is designated at 30. In this case, the fairings are firmly attached along their upper edges to the below-chine surfaces of the side hulls 16, and at their lower aft end portions the shells carry bearings 32 for supporting the aft ends of the propeller shafts 22—22 (FIG. 3). As shown, the fairings 30 extend at their forward ends to the craft's hull, and in this case the fairing may be interiorly partitioned adjacent its forward end by means of a transverse wall plate 31. Also, a transverse wall plate 34 (FIGS. 3 and 6) is positioned therein so as to divide it into a pair of separate sea chests 36,38. However, as shown at FIGS. 11 and 12, the fairing may be in the form of a shaft supporting strut configured generally along the lines of the fairing of FIGS. 1 and 3, but having its leading edge 39 streamlined as shown at FIG. 12.

In any case, the bottom wall portion of the fairing is inclined in parallel with the drive shaft 22, but in spaced relation therefrom. As shown in FIGS. 3 and 4, in the region of the foremost sea chest the fairing is formed with a water inlet slot 40 through its curved bottom wall portion extending parallel to and adjacent the uprising side of the propeller drive shaft 22 whenever the drive shaft is rotating so as to drive the ship "ahead". Thus, the invention utilizes the capability of a shaft when rotating in water to act as a pump for moving water in the direction of its rotation. Therefore, in this case the pumping action of the shaft cooperates with the ramming action above referred to, thereby assisting in forcing water through the slot 40 into the sea chest 36 when the shaft is rotating so as to propel the craft forwardly. Accordingly, it is requisite that the angle of offset of the slot 40 relative to the vertical axis through the drive shaft must in all cases be located adjacent to the uprising side of the shaft when it is rotating to move the ship forwardly.

Thus for example, in the case where the starboard side propeller shaft 22 is designed to be rotated in clockwise direction as viewed in FIG. 4 for driving the ship ahead, the water inlet slot 40 will be located adjacent the lower left side portion of the drive shaft so that water entering the slot will be drawn upwardly into the sea chest 36 by the uprising side of the drive shaft. A baffle plate such as shown at 37 (FIG. 4) is preferably employed to preclude backflow from the sea chest. FIGS. 9 and 10 illustrate a modified form of the water inlet slot arrangement wherein the fairing structure at the base of the sea chest 36 terminates somewhat above the adjacent portion of the drive shaft, and an arcuately shaped baffle plate 42 is employed to permit the uprising surface of the drive shaft to pump water upwardly into the sea chest while preventing any substantial undesirable backflow therefrom.

As best shown at FIG. 6, in plan view the side wall portions of the fairing 30 are formed to converge toward one another at the aft end thereof so as to provide a streamlined rear end configuration and a reduced size vertically extending open slot as is designated at 44 (FIGS. 5 and 6). The sea chest 38 is closed at its bottom as by means of a plate 46, and the slot 44 thus provides an opening for water to be forced by the so-called ramming action into the sea chest 38 when the ship is moving backwardly.

Figure 13:
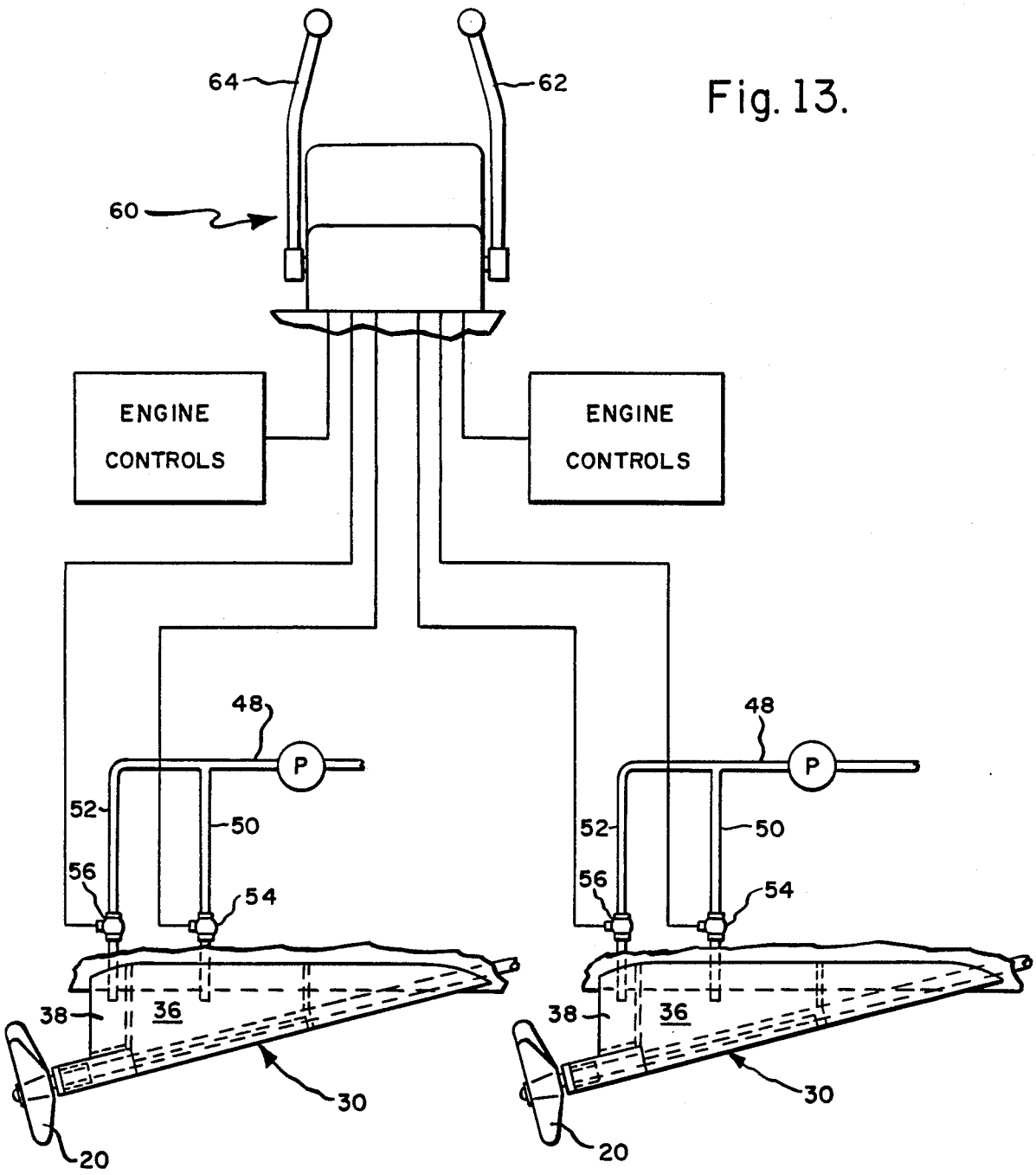
FIG. 13 is a schematic showing by way of example a suitable pilot control system in association with the water pump intake conduit branch valve controls of the invention.

The system for drawing water into the ship for engine cooling purposes and the like includes a pump and intake lines as shown at 48 having separate branch conduits 50,52 which reach downwardly into the sea chests 36,38, respectively for withdrawal of water therefrom. The passage of water through the conduits 50,52 is differentially controlled by valves 54,56 which are arranged to be actuated automatically by way of the craft propulsion control logic system. This of course may be of any suitable state of the art type, such as that which by way of example is shown schematically at FIG. 13. The pilot control console is shown at 60 from which extend starboard and port engine and propeller control handles 62,64, respectively. These handles are movable forwardly and rearwardly from neutral or "stop" positions so as to control the engine and reversible gear systems driving the corresponding propellers. Propeller speeds depend upon the degree of advancements of the handles in either direction away from their neutral positions.

When the handles of the control system are moved into "ahead" or "astern" positions the system automatically adjusts the pump water supply conduit branch control valves so that in accord therewith water will be drawn either from the foremost or rearmost sea chests of the fairing. When the handles 62,64 are in the neutral or "stop" position, the control system operates to keep open at least one set or both sets of the valves 54,56, so that when the engines are idling and not in gear to drive the propellers, cooling water is available by way of the sea chests. Thus, it will be understood that a constant supply of engine cooling water by way of the sea chests is always assured, regardless of the direction of ship travel or sea state conditions, or of any steering maneuvers of the ship such as would otherwise tend to cause broaching of the water pump intakes with consequent failure of the engine cooling system.

What is claimed is:

1. A water-cooled engine driven high speed marine surface craft of the type which is pilot controlled and operative by means of a craft operation control system in both ahead and reverse directions by means of an under water propeller carried at the rear end of an engine power driven shaft extending rearwardly and downwardly at an inclined angle from the hull of said craft, the improvement comprising:

the portion of said drive shaft between its propeller and said hull being enclosed by means of an internally partitioned fairing-shaped shroud extending from said hull;

said shroud being formed with water inlet apertures at both the forward and rear ends thereof, thereby providing a pair of sea chests internally thereof surrounding said shaft;

engine cooling water pump intake means comprising a conduit having separate branches thereof extending from said hull into said sea chests;

each of said branches having included therein an off/on water flow control valve; and means for differentially actuating said branch water flow control valves automatically in accordance with adjustments of said craft operation control system.

2. A craft of the type set forth in claim 1 wherein said shroud is so configured as to include a pair of side wall portions extending vertically from said hull in parallel spaced relation adjoined at their bottom portions by means of a curved bottom wall encircling the enclosed drive shaft in spaced relation therefrom, said shroud being closed at its forward end and the forward portion of said curved bottom wall in the region of the forward one of said sea chests being apertured to permit inlet of water thereinto, and the rear end wall portion of said shroud being apertured to permit inlet of water into the rearward one of said sea chests.

3. A craft of the type set forth in claim 2 wherein the apertured portion of said curved bottom wall in the regions of the forward one of said sea chests is configured in the form of an open slot extending in parallel but spaced relation from said shaft so as to expose the uprising side of said shaft to the ram effect inlet of water when said shaft is rotating so as to drive said craft ahead, and the apertured rear end portion of said shroud is configured so as to permit ram effect inlet of water into said rearward one of said sea chests when said craft is moving in reverse.

4. A craft as set forth in claim 3 wherein the rear end portion of said shroud mounts shaft supporting bearing means.

5. A craft as set forth in claim 3 wherein the apertured bottom wall portion of said shroud is angularly offset away from the bottom portion of said shroud and upwardly in parallelism with and adjacent to the uprising side of said shaft when said craft is being propelled and moving ahead.

6. A high speed marine surface craft as set forth in claim 5 wherein a baffle plate is provided closely adjacent to the downwardly turning side of said shaft to restrict backflow of water from said sea chest.

7. A high speed marine surface craft including essentially:

a hull;

a propeller shaft protruding rearwardly and at an angle downwardly from said hull and carrying at its distal end a propeller;

a craft propulsion control system operative to control the direction and speed of rotation of said shaft;

an externally streamlined hollow strut affixed to and extending from said hull and enclosing an under water portion of said shaft between said hull and said propeller;

said strut having a bottom wall portion extending downwardly at an angle rearwardly from said hull and curved in generally parallel spaced relation from said shaft, and terminating in streamline configurations at its forward end and at its rear end just ahead of said propeller;

said strut having a transverse vertically extending inner wall partitioning member dividing the interior of said strut into two separate foremost and rearmost chambers;

said bottom wall portion of said strut being apertured through its foremost chamber enclosing portion in parallelism with said shaft, and said rear end portion of said strut being centrally and vertically apertured; whereby said chambers within said strut provide two separate water accommodating sea chests;

water pump intake means comprising a conduit having separate branches extending from said hull into said sea chests;

each of said branches having included therein an off/on control valve; and means for differentially actuating said branch control valves automatically in accordance with operation of said craft propulsion control system.

8. A high speed marine surface craft as set forth in claim 7 wherein the rear end portion of said strut mounts a shaft supporting bearing.

9. A high speed marine surface craft as set forth in claim 7 wherein the apertured bottom wall portion of said strut is angularly offset from the bottom portion of said strut upwardly in parallelism with and adjacent to the uprising side of said shaft when said craft is being propelled to move ahead.

10. A high speed marine surface craft as set forth in claim 9 wherein a baffle plate is provided closely adjacent to the downwardly turning side of said shaft to restrict backflow of water from said sea chest.

* * * * *